United States Patent [19]

Driskill

[11] Patent Number: 4,801,167

[45] Date of Patent: Jan. 31, 1989

[54] DOWNHOLE WELL FISHING ASSEMBLY

[76] Inventor: Darrell Driskill, Rte. 5, Box 33D, Ardmore, Okla. 73401

[21] Appl. No.: 89,139

[22] Filed: Aug. 25, 1987

[51] Int. Cl.[4] ..... E21B 31/02

[52] U.S. Cl. ..... 294/86.3; 294/86.33; 294/86.18

[58] Field of Search ..... 294/86.3, 86.33, 86.31, 294/86.17, 86.28, 86.29, 86.25, 86.18, 86.19, 86.26, 86.29; 166/99; 175/315

[56] References Cited

U.S. PATENT DOCUMENTS

| | | | |
|---|---|---|---|
| 1,671,979 | 6/1928 | Cook . | |
| 1,687,808 | 11/0192 | Thomas et al. . | |
| 1,745,274 | 1/1930 | Sauls . | |
| 1,754,696 | 4/1930 | Sauls . | |
| 1,776,024 | 9/1930 | Hinderliter . | |
| 1,797,505 | 3/1931 | Jones et al. . | |
| 1,825,025 | 9/1931 | Thomas et al. . | |
| 1,970,624 | 3/1934 | Recker . | |
| 2,075,241 | 3/1937 | Thompson . | |
| 2,213,919 | 9/1940 | Michon . | |
| 2,272,529 | 2/1942 | Larson . | |
| 2,864,450 | 12/1958 | Burns | 294/86.3 |
| 3,368,834 | 2/1968 | Stratienko . | |
| 3,618,177 | 11/1971 | Wood . | |
| 3,815,987 | 12/1974 | Jones . | |
| 3,920,342 | 11/1975 | Warda . | |
| 3,950,021 | 4/1976 | Goldschild et al. . | |
| 4,185,865 | 1/1980 | Taylor . | |
| 4,548,437 | 10/1985 | Driskill . | |

*Primary Examiner*—James B. Marbert
*Attorney, Agent, or Firm*—Glen M. Burdick

[57] ABSTRACT

A fishing assembly for use in retrieving a separated or broken sucker rod from a well comprising a body member having a cavity in which a slide member is disposed therein for reciprocation within the body member. An entrance port is formed in the lower end of the body member so as to openly communicate with the cavity, and an elongated, longitudinally slot is formed in one side portion of the body member. A substantially arcuate-shaped internally disposed shoulder is supported by the body member substantially adjacent the entrance port so as to be opposite and in a facing relationship with the longitudinally extending slot of the body member. The slide member is connected to the body member via the slot so as to be reciprocably movable along the cavity axis of the body member from a lower position to an upper position. The slide member is biased in the lower position so that the slide member (when in the lower position) and the shoulder cooperate to capture a joint end of a separated rod. A tubular collet support barrel extends from the upper end of the body member, the tubular collet support barrel having a bore extending therethrough which is axially aligned with the cavity of the body member. A frustoconical surface is formed at the end of the collet support barrel adjacent the body member; and a collet is positioned within the bore of the collet support barrel for receiving and capturing a portion of the rod. The collet, which is biased toward the lower portion of the bore, is comprised of a plurality of depending fingers upon which a mating frustoconcial surface is formed so that a straight rod to can be gripped by the collet by placing such rod in the collet and drawing the collet into the lower end of the collet support barrel by an upwardly directed force on the assembly.

14 Claims, 2 Drawing Sheets

DOWNHOLE WELL FISHING ASSEMBLY

BACKGROUND OF THE INVENTION

1. Field of the Invention

The present invention relates generally to oil field service equipment, and more particularly, but not by way of limitation, to a downhole well fishing assembly for recovery of a separated downhole sucker rod.

2. Brief Description of the Prior Art.

The prior art is replete with various types of fishing tools for recovering separated or broken downhole sucker rods. For example, U.S. Pat. No. 2,272,529 (Larson) discloses a fishing tool for recovering a separated sucker rod comprising a rotatable barrel body having an eccentric sleeve. The eccentric sleeve, by selective rotation of the barrel body, is adapted to grip the downhole sucker rod portion that has separated. Once gripped, the fishing tool is brought to the surface, pulling the separated sucker rod with it.

Taylor, U.S. Pat. No. 4,185,865, discloses a fishing tool or overshot operable on a wire line for recovery of a separated downhole sucker rod. The fishing tool comprises a retractable set of collet fingers mounted in an overshot body. The collect fingers are engageable with the downhole member to be retrieved (i.e. a fish). Repeated bumping of the collet fingers against the fish extending into the collet fingers results in the opening or closing of the collet fingers via cam actuated internal rotation of the collet fingers. Thus, the fish pulls the collet fingers into gripping engagement as it pulls the closed collet fingers through a tapered opening in the overshot body. U.S. Pat. No. 4,548,437, issued to Driskill, discloses a fishing assembly having the ability to exercise positive control at the surface over subsurface, downhole fishing assemblies. The fishing tool comprises a body member having an offset entrance port into a cylindrical cavity that contains a slide member having a cylindrically-shaped upper portion and a trough-shaped lower portion. The trough-shaped lower portion is positionable adjacent the entrance port in either of two diametrically opposed angular positions to alternatively capture or release an enlargement on a rod inserted into the body member cavity via the entrance port. Grooves are cut into the cylindrically-shaped upper portion. A pin, mounted in the body member, engages the grooves such that the slide member is caused to rotate one half turn when the slide member is reciprocated in the cavity.

The fishing assembly of the Driskill patent also includes a tubular collet support barrel extending from the lower end of the body member to receive a collet. The collet includes a shank and an enlarged upper end so that the collet can be held in a raised position in one of the two angular positions of the slide member and the body member, or can be released to fall to the bottom of the collet support barrel in the other of the two angular positions of the slide member and the body member.

Each of the devices taught by the before-mentioned patents constituted improvement in an area occupied by numerous prior art fishing devices, especially the device taught by Driskill because of the ability of the device to exercise position control at the surface over subsurface, downhole fishing assemblies. However, even with such improvements in downhole fishing devices, the need remains for improved fishing devices which are capable of capturing either the enlarged portion of a separated downhole sucker rod or the body portion of such sucker rod, while being economical to manufacture and substantially maintenance free. It is to such a downhole well fishing assembly that the subject invention is directed.

SUMMARY OF THE INVENTION

The present invention provides an improved fishing assembly for use in retrieving a separated or broken sucker rod from a well. Broadly, the fishing assembly comprises a body member having a cavity in which a slide member is disposed therein for reciprocation within the body member. The body member is further provided with an entrance port formed in the lower end thereof so as to openly communicate with the cavity, and an elongated, longitudinally extending slot formed in one side portion of the body member. A substantially arcuate-shaped internally disposed shoulder is supported by the body member substantially adjacent the entrance port.

The arcuate-shaped internally disposed shoulder is provided with a relatively large radial thickness in a medial portion and narrowing to substantially zero at its respective ends. The shoulder is positioned within the body member so that the medial portion is disposed opposite and in a facing relationship with the side of the body member containing the longitudinally extending slot.

The slid member is characterized as a curved, substantially semi-cylindrical slide member having an upper end and an opposed lower end. The slide member is connected to the body member by a connecting member supported by the slide member so that the connecting member extends through the elongated slot and permits the slide member to be reciprocably movable along the cavity axis of the body member from a lower position to a upper position. The slide member is biased in the lower position adjacent the entrance port such that the slide member (when in the lower position) and the internally disposed shoulder cooperate to effectively reduce the diameter of the entrance port to permit a joint end of a separated rod to be captured by the assembly. That is, when a joint or end of a sucker rod unit is inserted into the body member via the entrance port, the joint engages the lower end of the slide member. Continued application of a downwardly directed force on the fish assembly causes the joint of the sucker rod unit to move the slide member to the upper position. When the slide has been moved to upper position sufficient to permit the joint to clear the internally disposed shoulder of the body member, the biased slide member is moved to the lower position. Thus, the slide member and the internally disposed shoulder cooperate to reduce the diameter of the entrance port and thus capture the joint of the separated rod.

The fish assembly of the present invention is also provided with a tubular collet support barrel extending from the upper end of the body member, the tubular collet support barrel having a bore extending therethrough which is axially aligned with the cavity of the body member. The bore of the tubular collet support barrel has a diameter less than the diameter of the cavity of the body member. A frustoconical surface is formed at the end of the collet support barrel adjacent the body member; and a collet is positioned within the bore for receiving and capturing a portion of the rod engaged by the collet.

The collet, which is biased toward the lower portion of the bore, comprises a plurality of depending fingers upon which a mating frustoconical surface is formed so that a straight rod can be gripped by the collet by placing such a rod into the collet and drawing the collet into the lower end of the collet support barrel by an upwardly directed force on the assembly.

An object of the present invention is to provide an improved fishing assembly for use in retrieving a downhole member from a well which be used to capture either a joint on one end of the separated sucker rod, or a portion of the straight rod forming the sucker rod.

Another object of the present invention, while achieving the before-stated object, is to provide an improved fishing assembly which is easily operable to grasp a rod located in a well.

A further object of the present invention, while achieving the before-stated objects, is to provide a fishing assembly which is economical to manufacture, multipurpose in function, and substantially maintenance free.

Other objects, advantages and features of the present invention will become apparent from the following detailed description when read in conjunction with the drawings and the appended claims.

DETAILED DESCRIPTION

Figure 1:
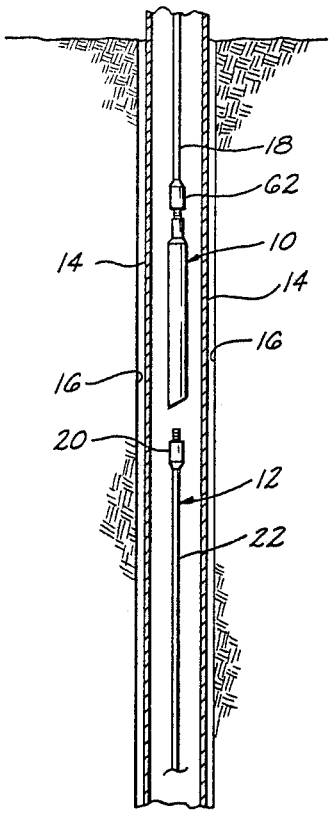
FIG. 1 is a cutaway, schematic representation of an oilwell containing a separated sucker rod and depicting the fishing assembly of the present invention being lowered to retrieve the sucker rod.

Referring now to the drawings, and more particularly to FIG. 1, a fishing assembly 10 constructed in accordance with the present invention is used to provide a connection to a downhole member or fish 12, such as a sucker rod, disposed in a casing 14 of a well bore 16 so that the fish 12 can be retrieved from the well bore 16. In use, the fishing assembly 10 is lowered into the casing 14 via a supporting member 18, which can be a rod or wireline, so that, once the connection to the fish 12 has been made, the fish 12 can be drawn upwardly from the well by application of an upwardly directly force on the supporting member 18.

As illustrated in FIG. 1, the supporting member 18 is a rod and the fish 12 is a sucker rod that has become separated from sucker rods which would normally connect the sucker rod constituting the fish 12 to a polish rod of a pumping unit disposed on the earth's surface. In such instance, the fish terminates at its upper end in an enlarged joint portion 20 by means of which successive sucker rods in a string are connected together to provide the connection between the pumping unit polish rod and a downhole pump. However, it should be noted that the fishing assembly 10 of the present invention is not limited to the application of capture of only the joint portion 20 of the fish 12, but as will be discussed hereinafter, the fishing assembly 10 can also be employed to capture the fish 12 when the fish 12 has broken at a rod portion 22 (i.e. the small diameter portion of the broken sucker rod or fish) such that the rod portion 22 extends upwardly from an enlarged joint portion, such as the joint 20.

Figure 2:
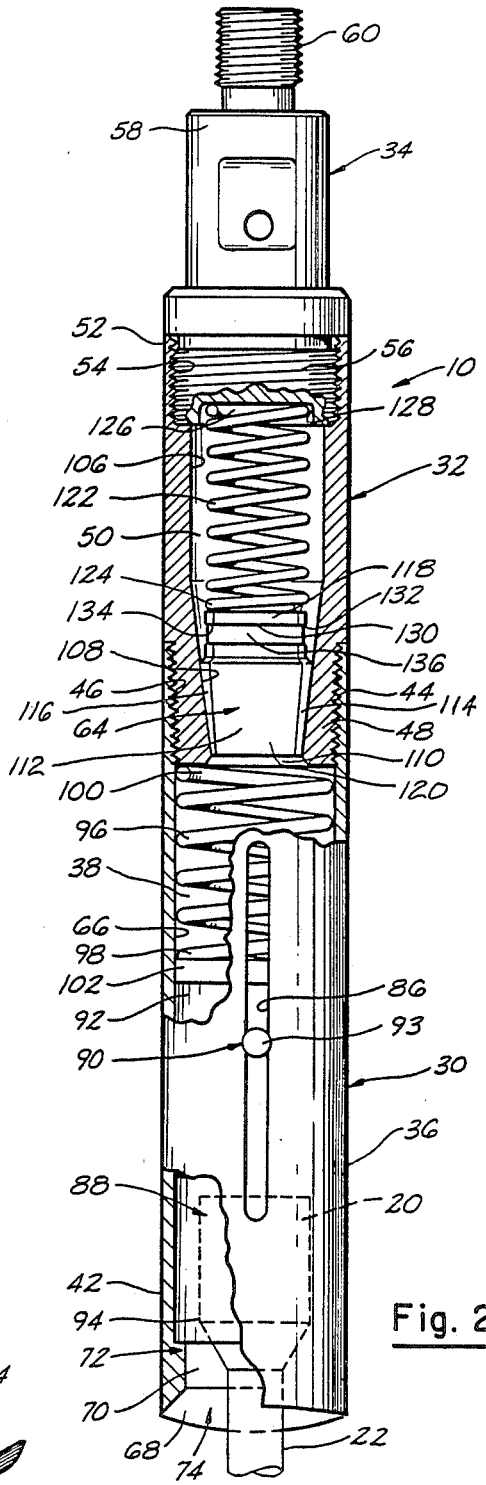
FIG. 2 is a partial cutaway, cross-sectional side elevational view of the fishing assembly shown in FIG. 1 wherein a joint portion (indicated in phantom) of a separate of sucker rod has been captured by the fishing assembly.
Figure 6:
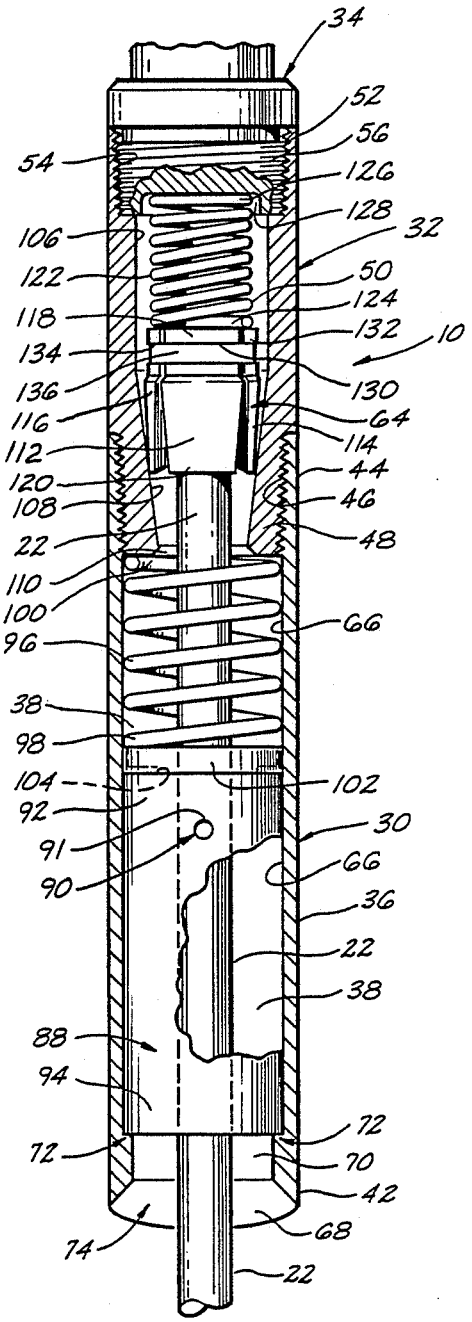
FIG. 6 is a partial cutaway, cross-sectional side elevational view of the fishing assembly of FIG. 1 showing a captured sucker rod wherein both the collet has been employed to selectively captured the separated sucker rod.

Referring now to FIGS. 2 and 6, the fishing assembly 10 comprising a body member 30, a tubular collet support barrel 32 and an end cap member 34. The body member 30 and the tubular collet support barrel 32 are formed in two parts to facilitate machining of the body member 30 and the tubular collet support barrel 32, and to enable the fishing assembly 10 to be adjusted to fit the particular job at hand.

Figure 6A:
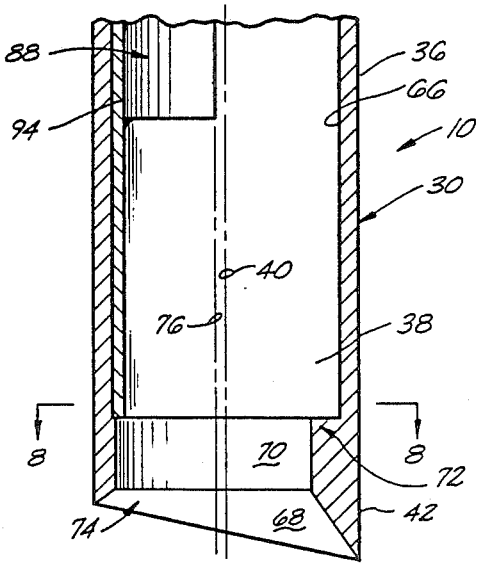
FIG. 6A is a cross-sectional side elevational view of the lower end portion of the body member of the fishing assembly of the present invention and showing a slide member is in an upper position.

The body member 30 is a substantially tubular sleeve 36 defining a cylindrical cavity 38 about a cavity axis 40 (see FIG. 6A). The tubular sleeve 36 is characterized as having a lower end 42, that forms a lower end of the body member 30, and an upper end 44. Portions of the upper end 44 of the tubular sleeve 36 defining the cavity 38 are provided with internally disposed threads 46 which are adapted to threadably engage a threaded lower portion 48 of the tubular collet support barrel 32 so that the body member 30 can be assembled to the tubular collet support barrel 32 by screwing the threaded lower end portion 48 of the tubular collet support barrel 32 into the upper end 44 of the tubular sleeve 36.

The tubular collet support barrel 32 is further characterized as having a bore or cavity 50 extending therethrough, and an upper end 52. The upper end 52 of the tubular collet support barrel 32 is provided with internally disposed threads 54; and the end cap member 34 is provided with a threaded lower portion 56 so that the end cap member 34 can be assembled to the upper end 52 of the tubular collet support barrel 32 by screwing the end cap member 34 into the upper end 52 of the tubular collet support barrel 32.

Figure 7:
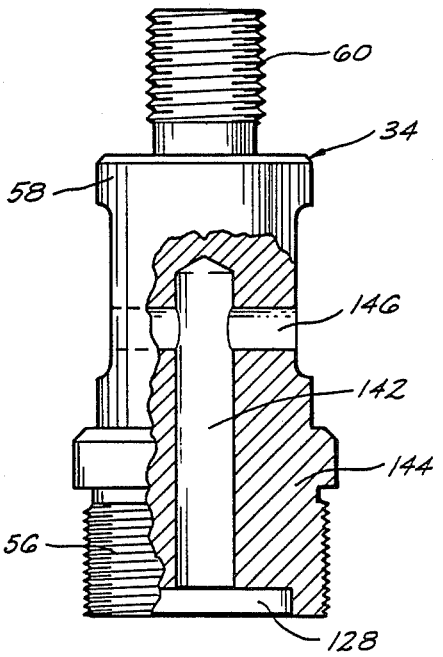
FIG. 7 is a partial cutaway, cross-sectional side elevational view of an end cap of the tubular collet support barrel of the fishing assembly of the present invention.

As illustrated in FIGS. 2 and 7, the end cap member 34 has an upper end 58, forming an upper end of the fishing assembly 10, and portions of the end cap member 34 adjacent the upper end 58 thereof are provided with external threads 60 so that the end cap member 34, and thus the fishing assembly 10, can be screwed into a joint 62 (FIG. 1) on the lower end of the rod 18 for lowering the fishing assembly 10 into the casing 14. In the case where the fishing assembly 10 is lowered into the casing 14 by a wireline, a female screw connector (not shown), but equivalent to the joint 62, can be attached to one end of the wireline so that the end cap member 34 can be threadably connected into such a connector for lowering the fishing assembly 10 into the casing 14.

As shown in FIGS. 2 and 6, the bore or cavity 50 of the tubular collet support barrel 32 is provided with a diameter less than the diameter of cylindrical cavity 38 of the tubular sleeve 36. Further, the lower portion of the bore or cavity 50 of the tubular collet support barrel 32 is provided a frustoconical configuration so as to receive and support a collet member 64 as will be more fully set forth hereinafter.

As shown in FIGS. 2, 6 and 6A, the cylindrical cavity 38 is divided into serially disposed portions: a cylindrical upper portion 66 that intersects the upper end 44 of the tubular sleeve 36 and extends therefrom towards the lower end 42 of the body member 30; a frustoconical lower portion 68 that intersects the lower end 42 of the body member 30 and extends toward the upper end 44 of the body member 32; and a central portion 70 that extends between the upper and lower portions 66 and 68. The central portion 70 of the cylindrical cavity 38 has a diameter that is smaller than the diameter of the upper portion 66 so that an internal shoulder 72 is formed in portions of the cylindrical cavity 38 adjacent the lower end 42 of the body member 30. The shoulder 72 forms the lower end of the cylindrical cavity 38 that extends axially through the body member 22. That is, the central axis of the lower end 42 forming an entrance port 74 is represented in FIG. 6A by the axis 76; whereas the longitudinal centerline axis for the tubular sleeve 36, and thus the tubular collet support barrel 32, is represented by the longitudinal central axis 40.

The lower and central portions, 68, 70 of the cylindrical cavity 38, which form the entrance port 74 into the cavity 38, are thus constructed so that the entrance port 74 is offset to one side of the lower end of the cylindrical cavity 38 by forming the lower and central portions 68 and 70, respectively, of the cylindrical cavity 38 about the axis 76 that parallels the cavity axis 40 and is spaced a distance from the cavity axis 40.

Figure 8:
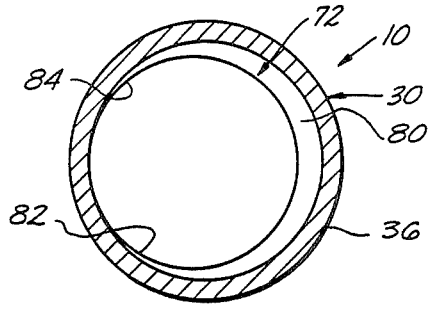
FIG. 8 is a cross-sectional view of the lower end portion of the fishing assembly shown in FIG. 6A taken along the line 8—8 to illustrate the internal arcuate-shaped shoulder.

As more clearly shown in FIG. 8, the internally disposed shoulder 72 is a substantially arcuate shaped shoulder having a medial portion 80, and end portions 82 and 84. The medial portion 80 of the shoulder 72 is provided with a relatively large radial thickness, and the shoulder 72 narrows to substantially zero thickness at its respective ends 82 and 84.

It will thus be seen that the enlarged or joint portion 20 of the rod 22 can be introduced into the cylindrical cavity 38 by bringing the fishing tool 10 down upon the upper end of the rod 12 to permit the joint portion 20 to enter the cylindrical cavity 38 via the entrance port 74. The entry of the joint portion 20 of the rod 22 into the cylindrical cavity 38 is facilitated by the frustoconical shape of the lower portion 68 of the cylindrical cavity 38 which results in the cylindrical cavity 38 flaring at the lower end 42 of the tubular sleeve 36 forming the body member 30.

The tubular sleeve 36 of the body member 30 is provided with an elongated, longitudinally extending slot 86 formed in the medial portion of one side thereof substantially as shown in FIG. 2. The slot 86 openly communicates with the cylindrical upper portion 66 of the cylindrical cavity 38 and is positioned so as to be oppositely disposed to the medial portion 80 of the internal shoulder 72 which is formed in the lower end 42 of the tubular sleeve 36 so as to define the central portion 70 of the cavity 38.

The fishing assembly 10 further comprises a slide member 88 which is disposed within the cylindrical upper portion 66 of the cylindrical cavity of 38 the tubular sleeve 36 so as to be selectively reciprocated therein. A connector member 90 is secured to the slide member 88 such that the connector member 90 is extendable through the elongated, longitudinally extending slot 86 and slidably retained therein to secure the slide member 88 to the tubular sleeve 36. Thus, the connector member 90 and the elongated, longitudinally extending slot 86 permit the reciprocal movement of the slide member 88 within the tubular sleeve 36 between a lower position (FIG. 6) and an upper position (FIG. 6A). In addition, it should be noted that portions of the shoulder 72 engage and support a lower end of the slide members 88 when the slide member 88 is in the lower position.

Any suitable member can be used as the connector member 90 provided such member permits the slide member 88 to be connected to the tubular sleeve 36 via the slot 86 so that the slide member 88 can be selectively reciprocated therein. For example, the connector member 90 is illustrated as having a body portion 91 (FIG. 6) connected at one end to the slide member 88 such that an opposed end extends outwardly from the tubular sleeve 36 via the slot 86. An enlarged cap or head portion 93 (which has a diameter greater than the width of the slot 86) is connected to body portion 91 external the tubular sleeve 36 substantially as shown in FIG. 2. Thus, the body portion 91 and the head portion 93 permit the slide member 88 to be slidably retained within the cavity 38 of the tubular sleeve 36 of the body member 30.

Figure 5:
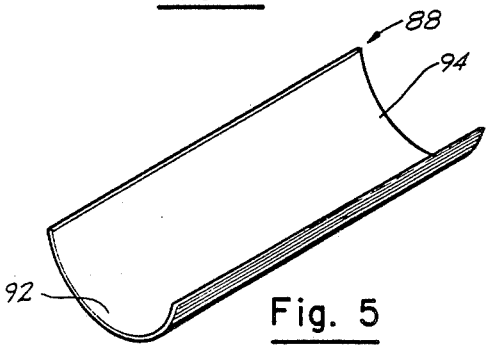
FIG. 5 is an isometric view of a slide member of the fishing assembly of the present invention.
Figure 3:
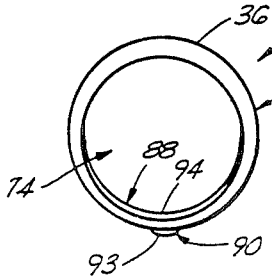
FIG. 3 is an end plan view of the fishing assembly shown in FIG. 2.

Referring more specifically to FIGS. 5 and 6, the slide member 88 is illustrated as a curved, substantially semicylindrical slide member having an upper end 92 and an opposed lower end 94. As previously stated, the slide member 88 is disposed within the cylindrical cavity 38 in the body member 30 for reciprocation along the cavity axis 40 from the lower position to the upper position. That is, in the lower position the slide member 88 is disposed substantially adjacent the entrance port 74 of the body member 30 and engages a portion of the internal shoulder 72 such that the slide member 88 is supported thereon. When a joint portion 20 of the rod 22 is inserted into the entrance port 74 of the body member 30, the joint portion 20 engages the lower end 94 of the slide member 88. Continued downwardly directed force causes the joint portion 20 to move the slide member 88 towards its upper position. When the slide member 88 has been moved in the upper position, that is, the lower end 94 thereof is disposed upwardly from the internal shoulder 72 a sufficient distance to permit the joint portion 20 of the rod 22 to clear the shoulder 72 and be inserted into the cylindrical cavity 38 via the entrance port 74, the slide member 88, which is biased in the lower position by a compression spring 96, returns to the lower position. Thus, the slide member 88 and the shoulder 72 cooperate to restrict or reduce the diameter of the entrance port 74 and thereby capture the enlarged or joint portion 20 of the rod 22 disposed within the cavity 38 of the body member 30 substantially as shown in FIG. 6.

As illustrated in FIG. 6, the compression spring 96 is provided with a first or lower end 98, and an opposed second or upper end 100. The compression spring 96 is disposed within the cylindrical upper portion 66 of the cavity 38 so that the lower end 98 of the compression spring 96 engages the upper end 92 of the slide member 88; and the upper end 100 of the compression spring 96 engages the threaded lower portion 48 of the tubular collet support barrel 32. To insure contact between the lower end 98 of the compression spring 96 and the upper end 92 of the slide member 88, a collar member 102 having a centrally disposed bore 104 extending therethrough (the bore 104 being illustrated in phantom in FIG. 6), is mounted on the lower end 98 of the compression spring 96 so as to provide a supporting planar surface for engagement with the upper end 92 of the slide member 88.

Referring now to FIGS. 2 and 6, the collet member 64 is loosely mounted in the bore 50 of the tubular collet support barrel 32 for axial movement in the bore 50. The bore 50 has a cylindrical upper portion 106, an upwardly facing frustoconical central portion 108, and a downwardly facing frustoconical lower portion 110. The frustoconical portion 110 at the lower end of the tubular collet support barrel 32 serves the same purpose as the frustoconical portion 68 of the cylindrical cavity 38 of the body member 30; that is, to facilitate the entry of a downhole member, such as the rod portion 22 of a broken sucker rod into the tubular collet support barrel 32 so that the rod portion 22 can be captured by the collet member 64.

Figure 4:
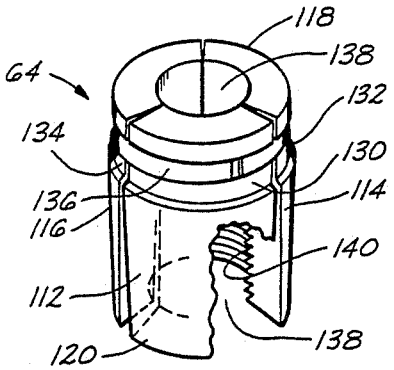
FIG. 4 is an isometric view of a collet of the fishing assembly of the present invention.

As indicated above, the collet member 64 is utilized to make a connection to the downhole member rather than the capture assembly formed by the slide member 88 and the shoulder 72. As can be seen in FIGS. 2,4 and 6, the collet member 64 comprises three finger members 112, 114 and 116 connected together so as to provide the collet member 64 with a substantially circular shaped upper end portion 118 and a substantially frustoconical shaped lower end portion 120 adapted to mate with the frustoconical central portion 108 of the bore 50 of the tubular collet support barrel 32. The circular shaped upper end portion 118 is provided with an outside diameter that will permit the collet member 64 to be loosely held within the cylindrical upper portion 106 of the bore 50 and to axially slide along the bore 50. The collet member 64 is biased in its lower position by a compression spring 122. That is, one end 124 of the compression spring 122 engages the circular shaped upper end 118 of the collet member 64; and an opposed second end 126 the compression spring 122 is disposed in a recess 128 formed in the threaded lower portion 56 of the end cap member 34. Thus, the compression spring 122 maintains the frustoconical shaped lower end portion 120 of the collet member 64 in a mating relationship with the central portion 108 of the bore 50 so as to be positioned to receive a rod portion of a downhole member and thereby capture same as will be described hereinafter.

Each of the finger members 112, 114 and 116 are identical in construction, and each is provided with an externally formed groove, such a grooves 130, 132 and 134, respectively, which are alignable and adapted to receive a connecting band 136 so that the fingers 112, 114 and 116 can be connected together to form the collet member 64. As illustrated in FIG. 4, internal surfaces of the fingers 112, 114 and 116 are curved to form a bore 138 into which a down hole member to be recovered can be inserted from the lower end portion 120 of the collet member 64. The internal surfaces of the fingers 112, 114 and 116 defining the frustoconical shaped lower end portion 120 of the collet member 64 are provided with upwardly facing teeth, such as upwardly facing teeth 140 formed on the internal surface of the finger 114. Thus, should the fishing assembly 10 be raised while a downhole member having a diameter slightly larger than the bore 138 formed by the internal surfaces of the fingers members 112, 114 and 116 is disposed in such bore, and while the collet member 64 is movable axially in the bore 50 of the tubular collet support barrel 32 against the force exerted on the collet member 64 by the compression spring 122, gripping of the downhole member would occur. That is, the teeth on the internal surfaces of the fingers, such as teeth 140 on the internal surface of the finger member 114, would bite into the downhole member so that the collet member 64 would remain stationary on the downhole member while the fishing tool 10 is drawn upwardly. With the collet member 64 stationary on the downhole member, the frustoconical shaped lower end portion 120 the collet member 64 would engage the surface of the frustoconical central portion 108 formed in the bore 50 of the tubular collet support barrel 32 so that the fingers members 112, 114 and 116 would be collapsed about the downhole member to grip the downhole member even more tightly as the fishing assembly 10 is drawn upwardly. Further, the compression spring 122 would insure that the collet member 64 is seated within the frustoconical central portion 108 at the lower end of the bore 50 and resists upward axial movement of the collet member 64 as the downhole member is inserted therein. Thus, the collet member 64 has an automatic gripping action; that is, so long as the collet member 64 is free to move within the bore 50 of the tubular collet support barrel 32 a downhole member that has been inserted into the bore 138 formed by the fingers members 112, 114 and 116 will be retained therein to form a connection between the fishing assembly 10 and such downhole member.

Referring now to FIG. 7, the end cap member 34 is illustrated. The end cap member 34 is provided with the recess 128 formed in the threaded lower portion 56 for receiving the opposed second end 126 of the compression spring 122. The end cap also includes an axially extending bore 142 formed in a lower portion 144 of the end cap 34 to intersect the recess 128 formed in the threaded lower portion 56 of the end cap 34. In addition to the bore 142, a transfer bore 146 is formed through the portions of the end cap 34 above the threaded portion thereof to intersect the upper end of the axial bore 142. The bore 146 and the bore 142 thus provide a relief port from the ambient through the cylindrical cavity 38 of the body member 30 and the bore 50 of the tubular collet support barrel 32 that permits well liquids to enter and leave portions of the cavity 38 above the slide member 88 and the bore 50 above the collet member 64 so that the well liquids will not interfere with the movement of the slide member 88 or the collet member 64 within the body member 30 and the tubular collet support barrel 32, respectively.

From the above description of the well assembly 10, and the operation of the slide member 88 and the collet member 64, it is clear that the present invention is well adapted to carry out the objects and attain the ends and advantages as well as those inherent therein. While presently preferred embodiments of the invention have been described for purpose of this disclosure, numerous changes may be made which will readily suggest themselves to those skilled in the art and which are encompassed within the spirit of the invention disclosed and as defined in the appended claims.

What is claimed is:

1. A fishing assembly for use in retrieving a downhole member from a well, comprising:

a body member having a cylindrical cavity formed in central portions thereof above a cavity axis and an entrance port through one end thereof and extending to one end of the cavity so that portions of a rod can be inserted into the cavity via the entrance port, the body member further having an elongated, longitudinally extending slot formed in a side portion thereof, the slot openly communicating with the cavity;

an arcuate-shaped internally disposed should supported by the body member substantially adjacent the entrance port, the shoulder having a relatively large radial thickness in a medial portion and narrowing to substantially zero thickness at its respective ends, the medial portion of the arcuateshaped shoulder being disposed substantially opposite and in facing relationship with the side portion of the body member having the elongated, vertically extending slot therein;

a curved, substantially semi-cylindrical slide member having an upper end and an opposed lower end, the slide member disposed within the cavity substantially adjacent the elongated slot in the body member for reciprocation along the cavity axis from a lower position to an upper position, in the lower position the lower end of the slide member being disposed substantially adjacent the entrance port of the body member and in an oppositely disposed facing relationship with the medial portion of the shoulder, in the upper position the lower end of the slide member being disposed upwardly from the shoulder a distance effective to permit an enlargement on a rod to be inserted into the cavity via the entrance port; and connecting means extendable through the elongated, longitudinally extending slot for connecting the slide member to body member and for permitting reciprocal movement of the slide member along the cavity axis.

2. The fishing assembly of claim 1 further comprising:

slide biasing means for biasing the slide member toward the lower position such that when the enlargement on the rod positioned within the cavity has cleared the arcuate-shaped shoulder the slide biasing means moves the slide member to the lower position wherein the slide member and the arcuate-shaped shoulder cooperate to restrict the diameter of the entrance port and thereby capture the enlargement within the cavity of the body member.

3. The fishing assembly of claim 2 further comprising:

a tubular collet support barrel mounted atop the body member and having a bore formed therethrough substantially coaxial to the cavity in the body member;

collet means disposed within the bore of the tubular collet support barrel for capturing a portion of a rod inserted into the bore of the tubular support barrel; and collet biasing means for biasing the collet means toward a lower end portion of the bore of the tubular collet support barrel.

4. The fishing assembly of claim 3 further comprising;

and end cap member mounted atop the tubular collet support barrel, the end cap member having means formed thereon for connecting the fishing assembly to a supporting member for lowering the fishing assembly into the well.

5. The fishing assembly of claim 4 wherein a relief port to the ambient is formed through the end cap to the bore of the tubular collet support barrel and the cavity of the body member.

6. The fishing assembly of claim 2 wherein the slide biasing means comprises:

a compression spring disposed between the upper end of the slide member and the tubular collet support barrel, the compression spring having a first end and an opposed second end; and a collar member having a centrally disposed bore extending therethrough, the collar member mounted on the first end of the compression spring for engagement with the upper end of the slide member.

7. The fishing assembly of claim 3 wherein the collet biasing means comprises a compression spring disposed within the bore of the tubular collet support barrel between the collet means and the end cap.

8. The fishing assembly of claim 3 wherein the collet means comprises:

a plurality of fingers, each of the fingers having an upper end portion and an opposed lower end portion, each of fingers having a recessed portion formed in the upper end portion; and connecting means positionable within the recessed portion of the fingers for connecting the fingers together at their respective upper end portions and provide a frustoconical shaped collet member wherein the lower end portions of the fingers can be caused to diverge and receive a portion of the rod and capture same when a rod is positioned therein and an upwardly directed force is placed on the fishing assembly.

9. A fishing assembly for use in retrieving a downhole member from a well, comprising:

a body member having a cylindrical cavity formed in central portions thereof above a cavity axis and an entrance port through one end thereof and extending to one end of the cavity so that portions of a rod can be inserted into the cavity via the entrance port, the body member further having an elongated, longitudinally extending slot formed in a side portion thereof, the slot openly communicating with the cavity;

an arcuate-shaped internally disposed shoulder supported by the body member substantially adjacent the entrance port, the shoulder having a relatively large radial thickness in a medial portion and narrowing to substantially zero thickness at its respective ends, the medial portion of the arcuateshaped shoulder being disposed substantially opposite and in facing relationship with the side portion of the body member having the elongated, vertically extending slot therein;

a curved, substantially semi-cylindrical slide member having an upper end and an opposed lower end, the slide member disposed within the cavity substantially adjacent the elongated slot in the body member for reciprocation along the cavity axis from a lower position to an upper position, in the lower position the lower end of the slide member being disposed substantially adjacent the entrance port of the body member and in an oppositely disposed facing relationship with the medial portion of the shoulder, in the upper position the lower end of the slide member being disposed upwardly from the shoulder a distance effective to permit an enlargement on a rod to be inserted into the cavity via the entrance port;

connecting means extendable through the elongated, longitudinally extending slot for connecting the slide member to body member and for permitting reciprocal movement of the slide member along the cavity axis;

a tubular collet support barrel mounted atop the body member and having a bore formed therethrough substantially coaxial to the cavity in the body member;

a collet assembly having a centrally disposed bore extending therethrough, the collet assembly being disposed within the bore of the tubular collet support barrel for capturing a portion of a rod inserted into the bore of the collet assembly; collet biasing means for biasing the collet assembly towards a lower end portion of the bore of the tubular collet support barrel; and an end cap member mounted atop the tubular collet support barrel, the end cap member having means formed thereon for connecting the fishing assembly to a supporting member for lowering the fishing assembly into the well.

10. The fishing assembly of claim 9 wherein a relief port to the ambient is formed through the end cap member to the bore of the tubular collet support barrel and the cavity of the body member.

11. The fishing assembly of claim 10 further comprising:

slide biasing means for biasing the slide member toward the lower position such that when the enlargement on the rod positioned within the cavity has cleared the arcuate-shaped shoulder the slide biasing means moves the slide member to the lower position wherein the slide member and the arcuate-shaped shoulder cooperate to restrict the diameter of the entrance port and thereby capture the enlargement within the cavity of the body member.

12. The fishing assembly of claim 11 wherein the slide biasing means comprises:

a compression spring disposed between the upper end of the slide member and the tubular collet support barrel, the compression spring having a first end and an opposed second end; and a collar member having a centrally disposed bore extending therethrough, the collar member mounted on the first end of the compression spring for engagement with the upper end of the slide member.

13. The fishing assembly of claim 9 wherein the collet biasing means comprises a compression spring disposed within the bore of the tubular collet support barrel between the collet assembly and the end cap member.

14. The fishing assembly of claim 13 wherein the collet assembly comprises:

a plurality of fingers cooperating to define the bore of the collet assembly, each of the fingers having an upper end portion and an opposed lower end portion and an externally disposed recessed portion formed in the upper end portion; and connecting means positionable within the recessed portion of the fingers for connecting the fingers together at their respective upper end portions and provide a frustoconical shaped collet member wherein the lower end portions of the fingers can be caused to diverge and receive a portion of the rod in the bore defined by the fingers and capture same when a rod is positioned therein and an upwardly directed force is placed on the fishing assembly.

* * * * *